US007984790B2

(12) United States Patent
Meyers et al.

(10) Patent No.: US 7,984,790 B2
(45) Date of Patent: Jul. 26, 2011

(54) FOLDING TRAY FOR FOLDABLE STEP STOOL

(75) Inventors: Thomas J. Meyers, Greenwood, IN (US); Todd C. Midkiff, Noblesville, IN (US)

(73) Assignee: Cosco Management, Inc., Wilmington, DE (US)

( * ) Notice: Subject to any disclaimer, the term of this patent is extended or adjusted under 35 U.S.C. 154(b) by 1037 days.

(21) Appl. No.: 11/757,886

(22) Filed: Jun. 4, 2007

(65) Prior Publication Data

US 2007/0284192 A1 Dec. 13, 2007

Related U.S. Application Data

(60) Provisional application No. 60/804,161, filed on Jun. 7, 2006.

(51) Int. Cl.
*E06C 1/14* (2006.01)

(52) U.S. Cl. ..... 182/129; 182/161; 182/163

(58) Field of Classification Search ..... 182/180.1, 182/129, 156, 159–163, 165
See application file for complete search history.

(56) References Cited

U.S. PATENT DOCUMENTS

| | | | | |
|---|---|---|---|---|
| 0,121,190 | A | 11/1871 | Oakley | |
| 0,159,319 | A | 2/1875 | Grunewald | |
| 0,137,884 | A | 5/1885 | Temple | |
| 0,540,948 | A | 6/1895 | Bruch | |
| 0,551,445 | A | 12/1895 | Liefer | |
| 0,554,695 | A | 2/1896 | Hood | |
| 0,847,205 | A | 3/1907 | Rowe | |
| 870,940 | A | 11/1907 | Dahl | |
| 0,920,733 | A | 5/1909 | Groves | |
| 1,110,700 | A | 9/1914 | LeVey | |
| 2,470,053 | A | 5/1949 | Salisbury | |
| 4,485,892 | A * | 12/1984 | Maloney et al. | 182/161 |
| 5,052,581 | A | 10/1991 | Christ et al. | |
| 5,715,909 | A | 2/1998 | Gagnon | |
| 5,722,507 | A * | 3/1998 | Kain | 182/129 |
| 5,752,581 | A | 5/1998 | Orchowski | |
| 6,427,805 | B1 * | 8/2002 | Gibson et al. | 182/165 |
| 2004/0238278 | A1 * | 12/2004 | Gibson et al. | 182/129 |
| 2005/0284701 | A1 | 12/2005 | Gibson et al. | |
| 2007/0284192 | A1 * | 12/2007 | Meyers et al. | 182/129 |

OTHER PUBLICATIONS

European Search Report dated Nov. 2, 2009, for EP 07252301.

* cited by examiner

*Primary Examiner* — Katherine Mitchell
*Assistant Examiner* — Daniel Cahn
(74) *Attorney, Agent, or Firm* — Barnes & Thornburg LLP

(57) ABSTRACT

The present disclosure relates to a step stool, and particularly to a folding step stool including legs that fold between an opened, use position and a collapsed, folded position. The present disclosure also relates to a tray assembly that moves relative to the legs and is used for storing or holding articles associated with use of the step stool. The step stool includes a mechanism to coordinate the movement of the tray assembly and a step of the step stool when the step stool is moved between the opened and collapsed positions.

16 Claims, 6 Drawing Sheets

FOLDING TRAY FOR FOLDABLE STEP STOOL

This application claims priority under 35 U.S.C. §119(e) to U.S. Provisional Application Ser. No. 60/804,161, filed Jun. 7, 2006, which is expressly incorporated by reference herein.

BACKGROUND

The present disclosure relates to a step stool, and particularly to a folding step stool including legs that fold between an opened use position and a collapsed storage position. More particularly, the present disclosure relates to a tray assembly that moves relative to the legs and is used for storing or holding articles associated with use of the step stool.

SUMMARY

In accordance with the present disclosure, a step stool includes a front leg unit, a rear leg unit coupled to the front leg unit, a tray mounted for pivotable movement on the front leg unit, a step pivotably coupled to the front leg unit, and a tray-step controller coupled to the tray and to the step such that when the step stool is folded, the step moves in a first rotational direction and the tray folds in a second rotational direction to a retracted, storage position. In an illustrative embodiment, the step-controller includes a bar configured to push a first portion of the tray upward thereby causing a second portion of the tray to move downward when the first step pivots in a first rotational direction toward a retracted, folded position.

In another illustrative embodiment, the step-controller includes a slider, a tray-mover and a step-mover. The slider is arranged to move slidably relative to and along the front leg unit, the tray-mover is pivotably coupled at a first end to the tray and pivotably coupled at a second end to the slider, and the step-mover pivotably is coupled at one end to the slider and pivotably coupled at another end to the step such that when the step pivots in a first rotational direction, the step-mover, the slider and the tray-mover cooperate to move a free end of the tray in a downward direction toward the front leg unit between an extended, use position and a retracted, storage position.

Additional features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
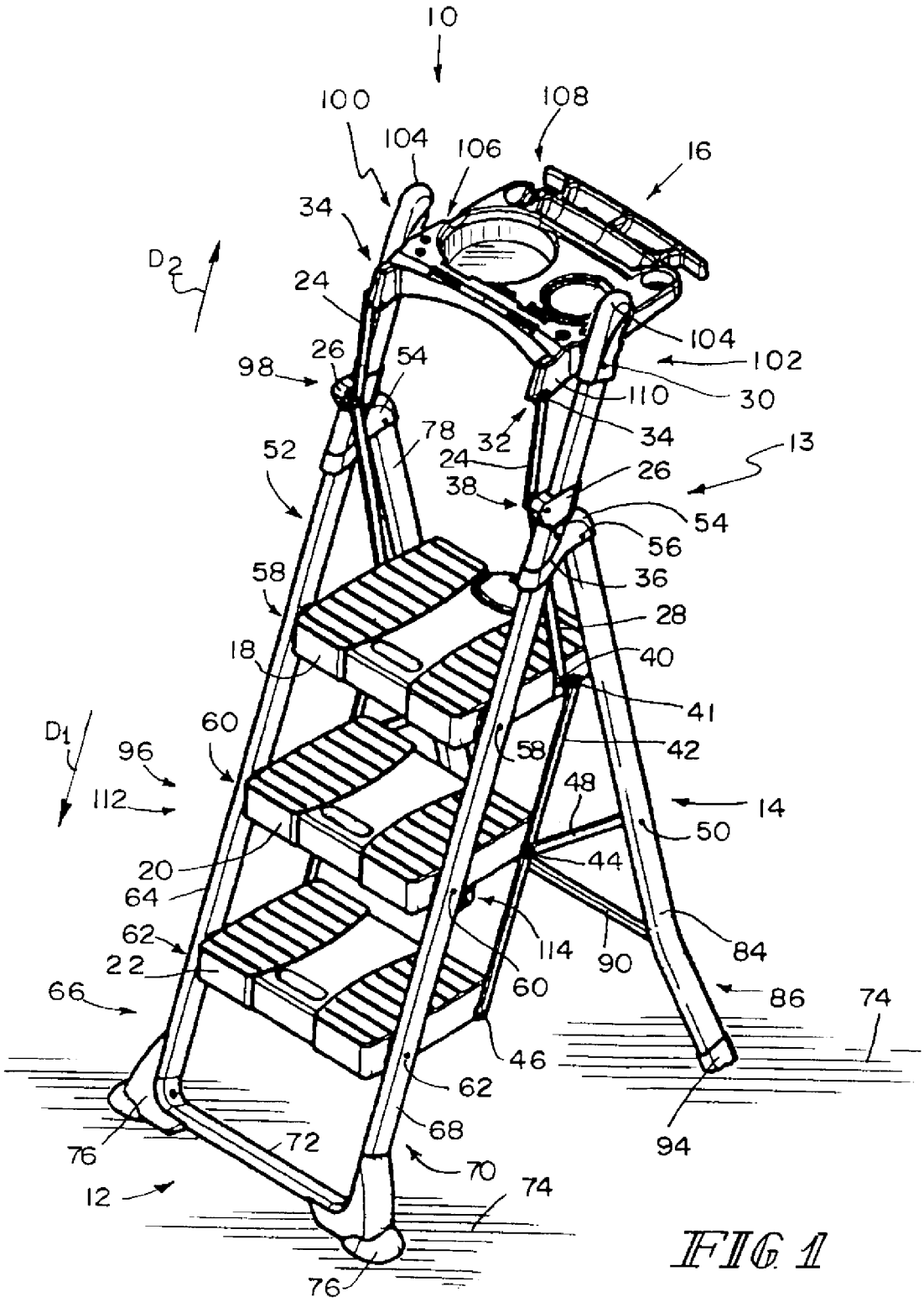
FIG. 1 is a perspective view of a step stool including a front leg unit, a rear leg unit coupled to the front leg unit, a tray mounted for pivotable movement on the front leg unit, and a tray-step controller coupled to the tray and to the front leg unit, and showing the step stool in an opened, use position and the tray in an extended, use position.
Figure 6:
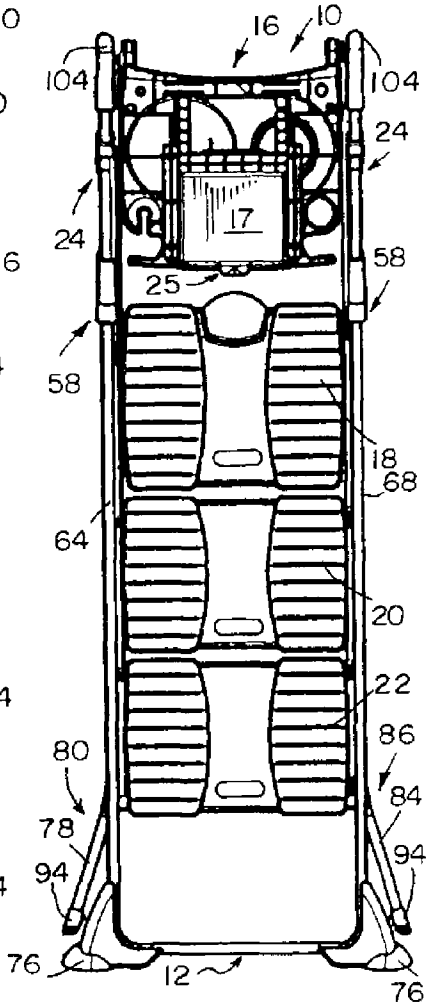
FIG. 6 is a front elevation view of the step stool shown in FIG. 5.
Figures 7, 8, 9:
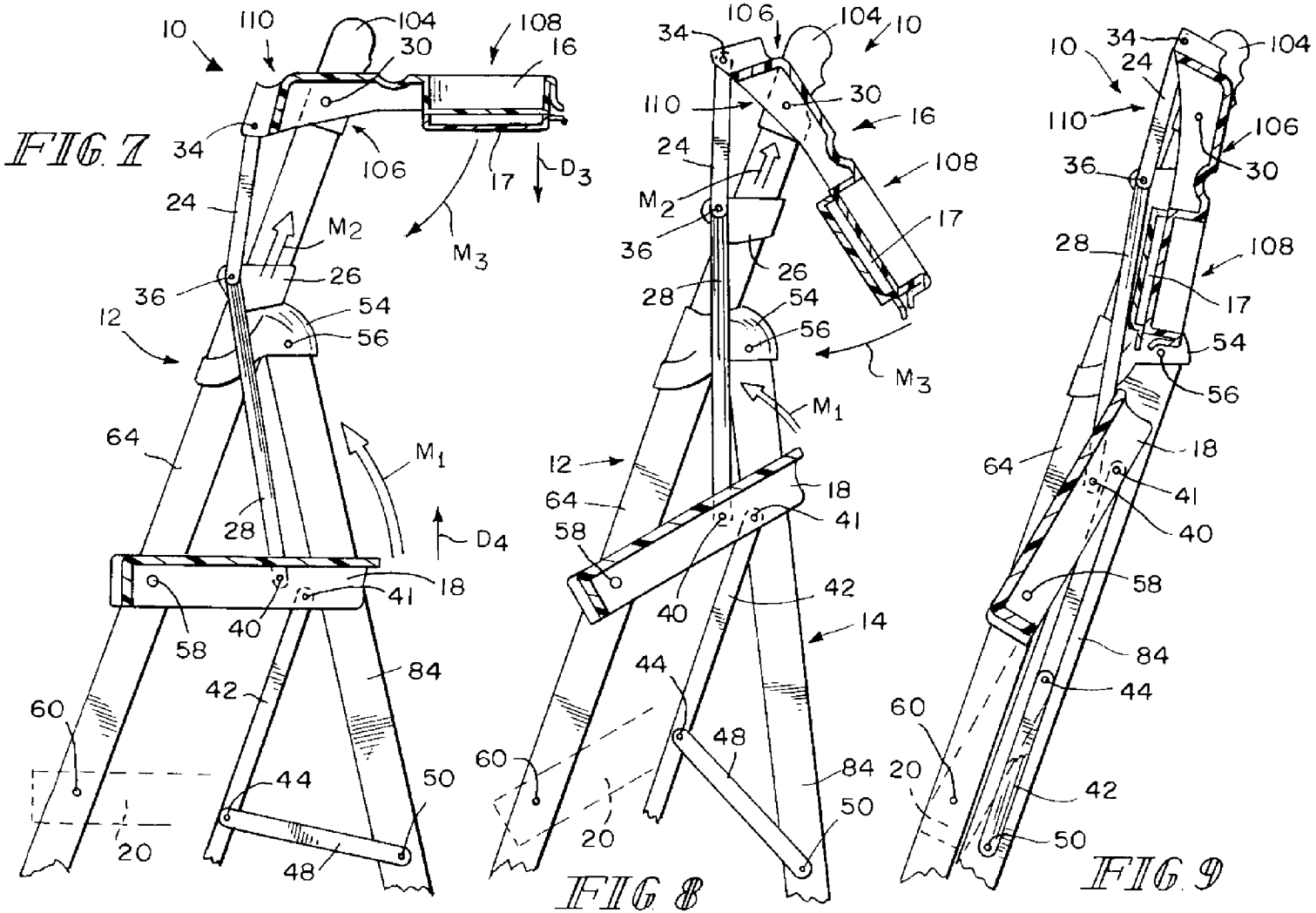
FIG. 7 is an enlarged sectional view taken along line 7-7 of FIG. 3 of a portion of the step stool shown in FIGS. 1, 3, and 4.
FIG. 8 is a sectional view similar to FIG. 7 showing use of the tray-mover to move the tray from the extended, use position shown in FIG. 7 to the retracted, storage position shown in FIG. 9.
FIG. 9 is a sectional view similar to FIGS. 7 and 8 showing the tray in the retracted storage position as shown in FIGS. 5 and 6.

In accordance with the present disclosure, an embodiment of a step stool 10 is shown in FIGS. 1-9. In the illustrated embodiment, a tray 16 is mounted for pivotable movement on a front leg unit 12. A tray-step controller 13 includes a tray-mover 24 pivotably coupled to the tray 16 and a slider 26 mounted on the front leg unit 12, as shown in FIGS. 1, 7 and 9. Also included in tray-step controller 13 is a step-mover 28 coupled to a first step 18 and to slider 26. When first step 18 is rotated about a first front pivot axis 58 and is lifted, as suggested in FIGS. 7 and 8, step-mover 28 causes slider 26 to move upward along the front leg unit 12 causing tray-mover 24 to rotate about a slider pivot axis 36 and move a rear or connected portion of tray 16 upwardly which causes the rest of the tray 16 to pivot downwardly at a first tray pivot axis 30 toward a retracted, storage position, as suggested in FIGS. 7-9. The upward movement of first step 18 brings step stool 10 to a folded, collapsed position and tray 16 to the retracted, storage position in a single folding motion, as shown in FIGS. 7-9.

Figure 2:
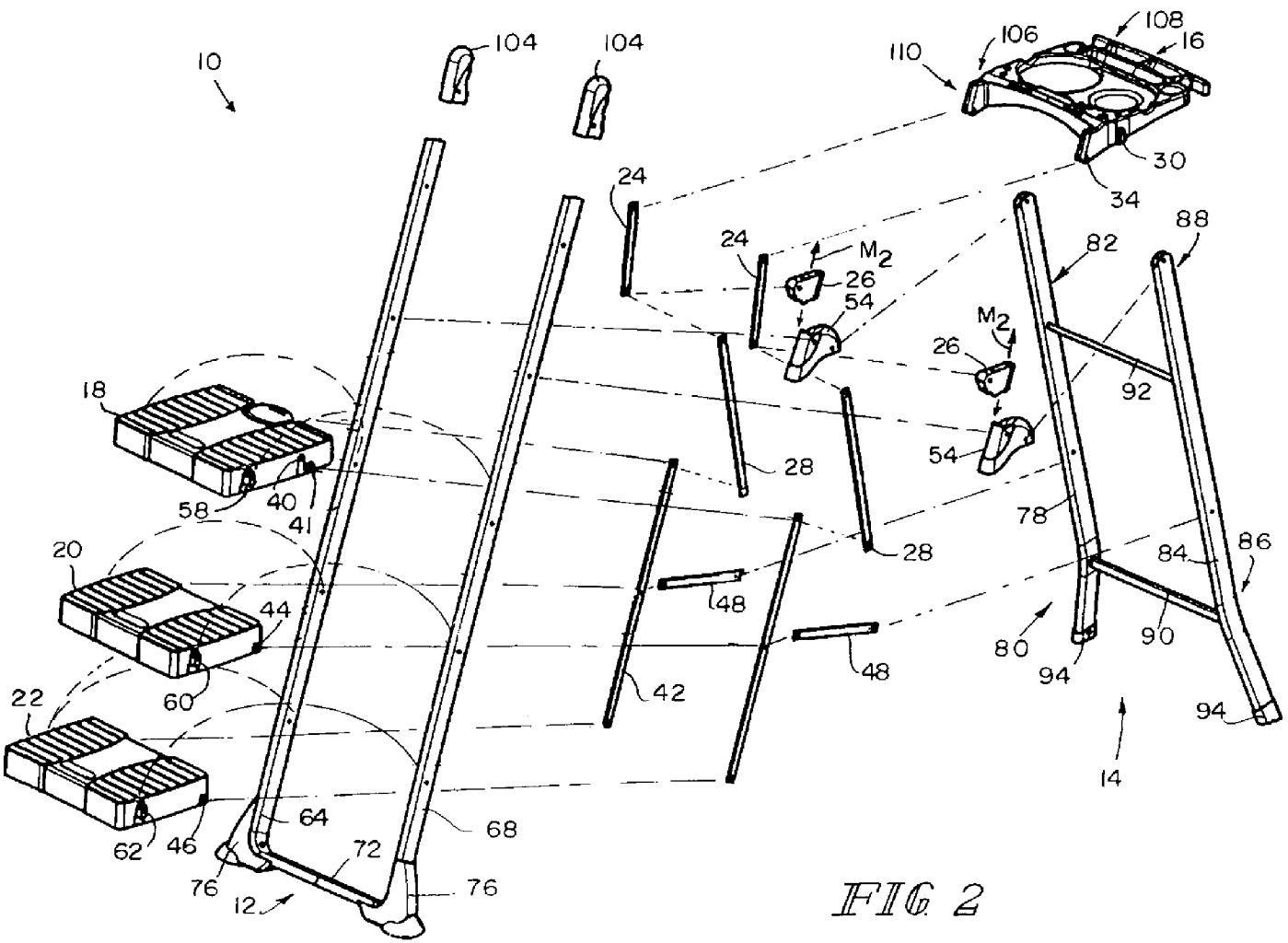
FIG. 2 is an exploded perspective view of the components included in the step stool of FIG. 1.

Step stool 10 includes front leg unit 12, rear leg unit 14, tray 16, first step 18, and second and third steps 20, 22 as shown, for example, in FIGS. 1 and 2. Step stool 10 also includes tray-step controller 13 comprising tray-mover 24, slider 26, and a step-mover 28, as also shown in FIGS. 1 and 2.

In an illustrated embodiment, as shown in FIG. 1, tray 16 is coupled to front leg unit 12 at the first tray pivot axis 30. Each tray-mover 24 is coupled at a first end 32 to tray 16 for pivotable movement about a second tray pivot axis 34. Slider 26 is mounted for sliding movement on front leg unit 12 and is coupled to a second end 38 of tray-mover 24 for pivotable movement about slider pivot axis 36. Step-mover 28 is coupled at one end to slider 26 for pivotable movement at slider pivot axis 36 and at an opposite end to first step 18 for pivotable movement at a first central pivot axis 40. A step-connector 42 interconnects first, second and third steps 18, 20 and 22, respectively, and is connected to first step 18 at a first rear pivot axis 41, to second step 20 at a second rear pivot axis 44, and to third step 22 at a third rear pivot axis 46. A rear leg bar or connector 48 is coupled to step-connector 42 for pivotable movement about the second rear pivot axis 44 and coupled to rear leg unit 14 for pivotable movement at a first leg pivot axis 50. Although rear leg bar 48 is shown pivotably connected at the second rear axis 44 with step 20 and step-connector 42, this connection may be at any point on step-connector 42 or at any point on steps 18, 20 and 22.

Front and rear leg units 12, 14 cooperate to define a foldable step stool frame 52 that is configured to support tray 16 and steps 18, 20, 22 as frame 52 is folded and unfolded. Rear leg unit 14 is coupled to front leg unit 12 by leg hinges 54 for pivotable movement at leg pivot points or first leg pivot axes 56 between an unfolded, use position of step stool 10 shown, for example, in FIGS. 1, 3, 4, and 7 and a folded, collapsed position of step stool 10 shown, for example, in FIGS. 5, 6, and 9. Steps 18, 20, and 22 are coupled to front leg unit 12 for pivotable movement at step pivot points or first front, second front and third front pivot axes 58, 60, and 62, respectively.

As suggested in FIGS. 1 and 2, front leg unit 12 comprises a left leg 64 having a lower end 66, a right leg 68 having a lower end 70, and a bottom cross-member 72 interconnecting legs 64 and 68. Each of the lower ends 66, 70 and cross-member 72 are adapted to contact ground 74 underlying frame 52. In illustrative embodiments, feet 76 are mounted on lower ends 66, 70. In illustrative embodiments, front leg unit 12 is U-shaped, as suggested in FIGS. 1 and 2.

As suggested in FIGS. 1 and 2, and best seen in FIG. 2, rear leg unit 14 comprises a left leg 78 having a lower end 80 and an upper end 82, a right leg 84 having a lower end 86 and an upper end 88, a lower cross-member 90 interconnecting lower ends 80, 86, and an upper cross-member 92 interconnecting upper ends 82, 88. In illustrative embodiments, lower ends 80, 86 are angled outwardly at a point at or below lower cross-member 90, as suggested in FIGS. 1 and 2. In illustrative embodiments, feet 94 are mounted on lower ends 80, 86, as suggested in FIGS. 1 and 2.

Figure 5:
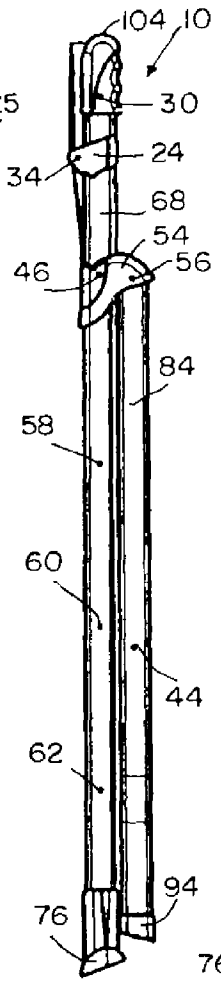
FIG. 5 is a right-side elevation view similar to FIG. 4 after movement of the front and rear leg units to the collapsed, storage position showing the tray in a retracted, storage position.
Figure 4:
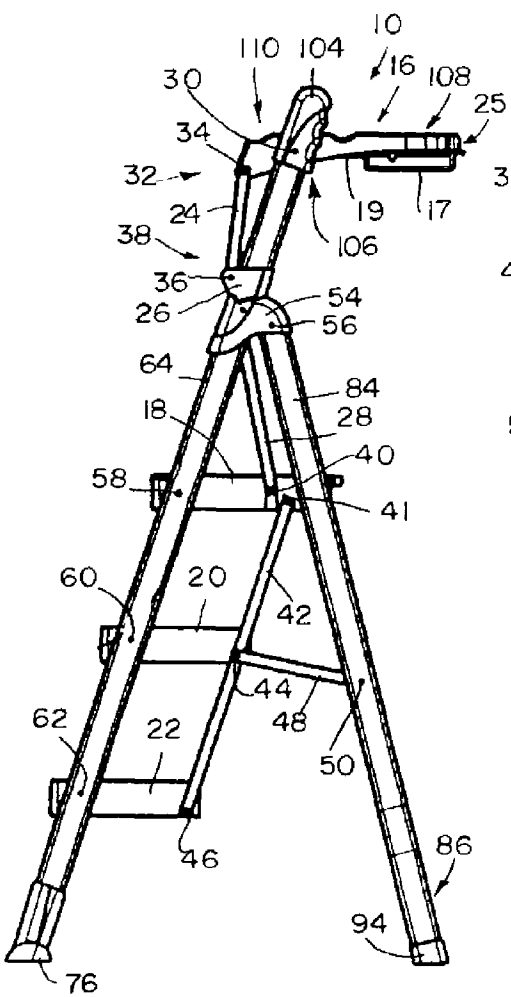
FIG. 4 is a right-side elevation view of the step stool of FIGS. 1 and 3 showing the tray in the extended, use position.
Figure 3:
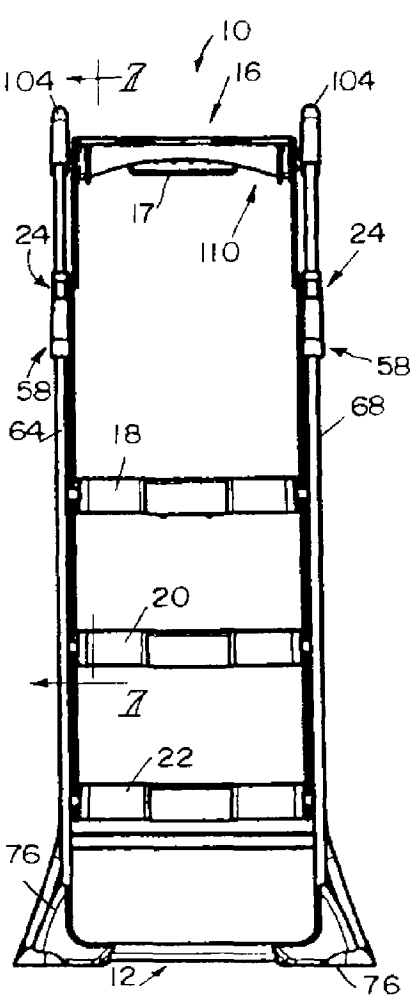
FIG. 3 is a front elevation view of the step stool of FIG. 1.

Upper ends 82, 88 of left and right legs 78, 84 of rear leg unit 14 are coupled, respectively, to left and right legs 64, 68 of front leg unit 12 at first leg pivot axis 56 of leg hinge 54 so that rear leg unit 14 is able to pivot relative to front leg unit 12 between an opened position away from left and right legs 64, 68 as shown, for example, in FIGS. 1, 4, and 7 and a folded, collapsed position alongside left and right legs 64, 68, as shown, for example, in FIGS. 5 and 9. As shown in FIGS. 1, 4, 8, and 9, first leg pivot axis 56 is located above first central pivot axis 40 and below first tray pivot axis 30.

Front leg unit 12 includes a lower section 96 comprising lower portions of left and right legs 64, 68 and an upper section 98 comprising upper portions of left and right legs 64, 68, as suggested in FIG. 1. Lower section 96 is arranged to extend downwardly from leg hinge 54 in direction $D_1$ and adapted to contact ground 74 underlying frame 52. Upper section 98 extends upwardly away from lower section 96 in direction $D_2$. Left and right legs 64, 68 include upper ends 100, 102 on which handles 104 are mounted for grasping by a user, for example, when ascending or descending step stool 10. Steps 18, 20, and 22 are coupled to lower section 96.

Tray 16 is mounted on a distal portion of upper section 98 and on upper ends 100, 102 of left and right legs 64, 68, respectively, of front leg unit 12 for pivotable movement about first tray pivot axis 30, as suggested in FIGS. 1, 4, 7, and 8. Tray 16 is also coupled to tray-mover 24 for pivotable movement about second tray pivot axis 34 and tray-mover 24 is coupled to slider 26 for pivotable movement about slider pivot axis 36.

Tray-mover 24 is configured to control pivoting movement of tray 16 relative to front leg unit 12 about first and second tray pivot axes 30, 34, respectively, during folding and unfolding of step stool 10. Tray-mover 24 is coupled to tray 16 for pivotable movement at first tray pivot axis 30 and to slider 26 for pivotable movement at slider pivot axis 36. Step-mover 28 is coupled at one end to slider 26 at slider pivot axis 36 and to first step 18 at first central pivot axis 40. Step-mover 28, slider 26, and tray-mover 24 comprise or are configured, for example, as tray-step controller 13, to cooperate to move tray 16 in a downward direction $D_3$ relative to front leg unit 12 between an extended, use position and a retracted, storage position when step 18 is moved in an upward direction $D_4$ relative to front leg unit 12, as suggested by the movement of step 18 in the direction of movement or rotation arrow $M_1$, the movement of slider 26 in the direction of movement arrow $M_2$, and the movement of tray 16 in the direction of movement or rotation arrow $M_3$, as suggested in FIGS. 7 and 8. The retracted, storage position of tray 16 is shown, for example, in FIGS. 6 and 9.

As suggested in FIGS. 1, 4, and 7, tray 16 includes a connected end 106 and a free end 108. Connected end 106 is coupled to front leg unit 12 for pivotable movement at first tray pivot axis 30. Connected end 106 is coupled to tray-mover 24 for pivotable movement at second tray pivot axis 34. Second tray pivot axis 34 is located on a rear overhang portion 110 of connected end 106 of tray 16. Connected end 106 is arranged to extend in a first direction from first tray pivot axis 30 and toward second tray pivot axis 34 when tray 16 is in an extended, use position, as suggested in FIGS. 1, 4, and 7.

Free end 108 is arranged to extend in a second direction from first tray pivot axis 34, opposite to the first direction, to overlie rear leg unit 14 when the step stool 10 is in the unfolded, use position, as suggested in FIGS. 4 and 7. Free end 108 and connected end 106 are arranged to extend along and lie essentially between left and right legs 64, 68 of U-shaped front leg unit 12 upon upward movement of step 18 relative to front leg unit 12 to the folded, collapsed position of step stool 10, as suggested in FIGS. 7-9. The upward movement of step 18 causes an upward movement of connected end 106 and a downward movement of free end 108 resulting in a side-by-side relation of tray 16 and front leg unit 12 and a compact step stool 10 in the folded, collapsed position, such that tray 16 does not extend vertically above frame 52 or handles 104 of step stool 10, and tray 16 is in a protected position essentially within the confines of the folded and collapsed step stool 10, as suggested in FIGS. 3, 5, 6, and 9.

Tray 16 also includes a drawer 17, as shown, for example, in FIGS. 3, 4, 6 and 10, slidably mounted to an underside 19 of tray 16. As shown, for example, in FIG. 11, drawer 17 includes a rail 21 coupled to tray 16 via, for example, screws 23 to provide a slideway for drawer 17. Drawer 17 is configured to extend to an opened position in a direction $D_3$ from first tray pivot axis 30, which is in a direction away from a user standing on the step 18, 20, 22 of step stool 10 and step stool 200 (discussed later herein) in the use position. Drawer 17 also includes a lock or latch mechanism 25 including, for example, a tongue 27 on drawer 17, a notch 29 on tray 16 and an actuator 31 on tongue 27 that cooperate to secure drawer 17 in an unopened or closed position and to release drawer 17 for movement to an opened position, as shown, for example, in phantom in FIG. 10.

Second step 20 is arranged to lie under first step 18 and between left and right legs 64, 68 of front leg unit 12, as suggested in FIG. 1. Second step 20 is coupled at mid-sections 112, 114 of left and right legs 64, 68 at a second front pivot axis 60 on each of legs 64, 68 for pivotable movement about second front pivot axis 60. Second step 20 is also coupled to step-connector 42 and rear leg bar 48 at second rear pivot axis 44 for pivotable movement about second rear pivot axis 44. Pivot bar 42 is coupled to left and right legs 78, 84 of rear leg unit 14 via rear leg bar 48 at second leg pivot axis 50 for pivotable movement about pivot axis 50, as suggested in FIGS. 7 and 8.

Third step 22 is arranged to lie under second step 20 and between left and right legs 64, 68 of front leg unit 12, as suggested in FIG. 1. Third step 20 is coupled to mid-sections 112, 114 of left and right legs 64, 68 at a third front pivot axis 62 on each of left and right legs 64, 68 for pivotable movement about third front pivot axis 62. Third step 22 is also coupled to pivot bar 42 at third rear pivot axis 46 for pivotable movement about third rear pivot axis 46.

Step-connector 42 interconnects steps 18, 20 and 22 at first, second, and third rear pivot axes 41, 44, and 46, respectively. When step 18 is lifted, step-connector 42 permits steps 20 and 22 to follow the pivotable movement of step 18 toward the folded, collapsed position of step stool 10, as suggested in FIGS. 7-9.

Tray-mover 24 is coupled to tray 16 for pivotable movement at second tray pivot axis 34 and coupled to slider 26 and step-connector 28 for pivotable movement at slider pivot axis 36. Step-connector 42 is coupled to step 18 for pivotable movement at first rear pivot axis 41. Step-connector 42 interconnects steps 18, 20, 22 at first, second, and third rear pivot axes 41, 44, 46, respectively. With the step stool 10 in the unfolded, use position as shown, for example, in FIGS. 1, 4, and 7, when step 18 is lifted to move step stool 10 to the folded, collapsed position, step 18, step-connector 42, step-mover 28, slider 26, and tray-mover 24 cooperate automatically, in a single operation, to move tray 16 downwardly in a first rotational direction and steps 18, 20, 22 upwardly in a second, opposite rotational direction such that tray 16 lies in side-by-side relation to front leg unit 12, and rear leg unit 14 pivots inwardly to lie in side-by-side relation to front leg unit 12. The step stool 10 is thus in the folded, collapsed position with tray 16 stored within the confines of the step stool 10 and not extending upwardly above frame 52 or beyond handles 104, as suggested in FIGS. 3, 6, and 9.

To move the step stool 10 from the folded, collapsed position, as shown in FIGS. 6 and 9, to the unfolded, use position, as shown in FIGS. 1, 4, and 7, rear leg unit 12 is pulled apart from front leg unit 14 and pivots about front leg pivot axis 56 on leg hinge 54, causing rear leg bar 48 to pivot about second leg pivot axis 50 on rear leg unit 14. That pivoting action causes step-connector 42 to move downward permitting steps 18, 20, 22 to pivot downward about first, second, and third rear pivot axes 41, 44, and 46, respectively, toward step positions that are essentially parallel to ground 74, as suggested in FIG. 1. When step 18 pivots downwardly, step-mover 28 pivots about first central pivot axis 40 on step 18 and pivot about slider pivot axis 36 on slider 26, thereby pulling slider 26 down along legs 64, 68 of front leg unit 14. As slider 26 moves downwardly, tray-mover 24 pivots about slider pivot axis 36 and pulls rear overhang position 110 of connected end 106 tray 16 downwardly, causing connected end 106 of tray 16 to pivot about first tray pivot axis 30 thereby moving free end 108 of tray 16 upwardly and bringing tray 16 to the extended, use position, as shown in FIGS. 1, 4, and 7. The extended, use position of tray 16 is able to be located at a relatively high position on step stool 10 because when step stool 10 is moved to the folded, collapsed position, tray 16 is rotated downwardly to the retracted, storage position within the confines of step stool 10.

Figure 10:
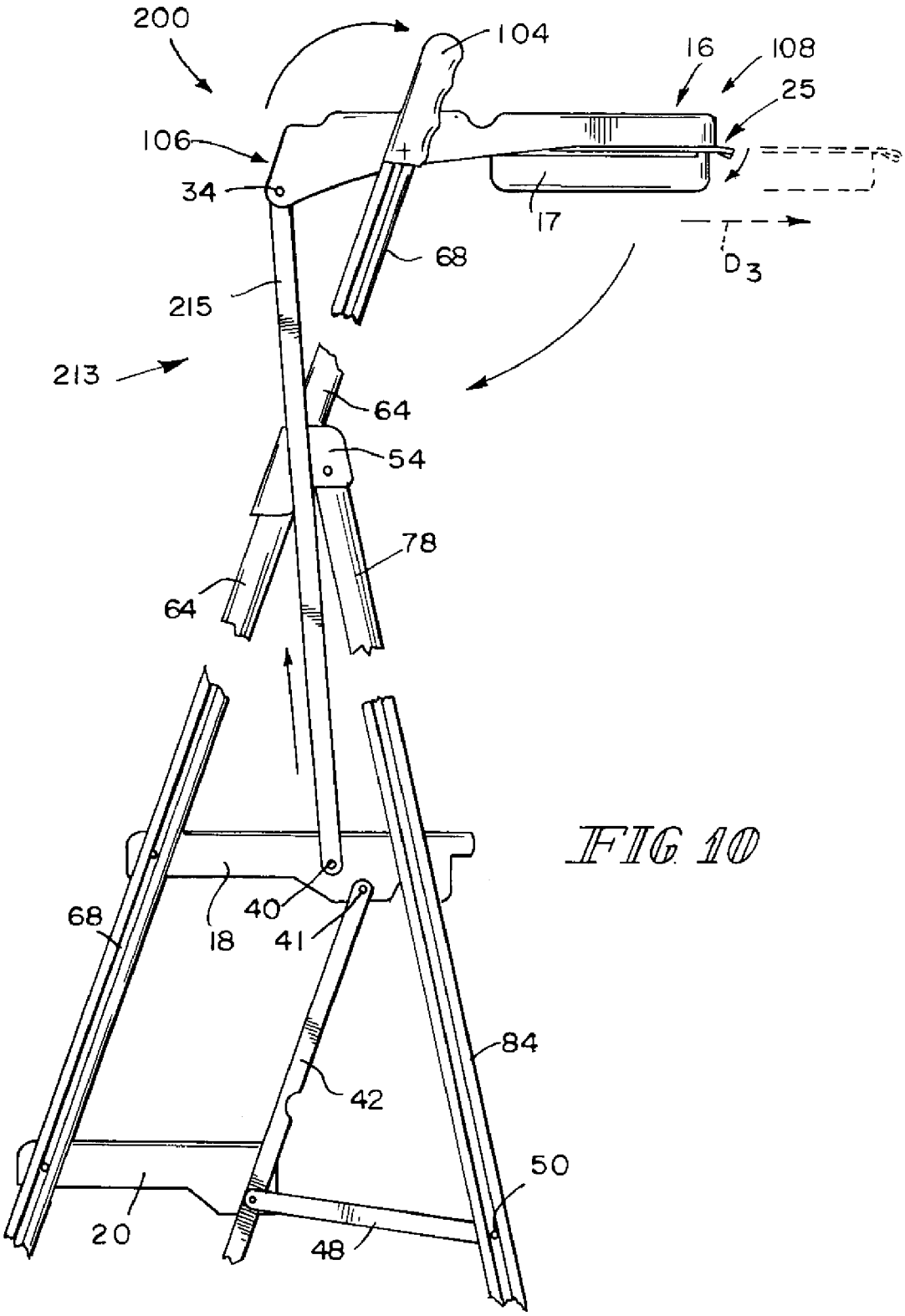
FIG. 10 is a right-side elevational view of another embodiment of a step stool, according to the present disclosure, with portions broken away exposing a tray-step controller pivotably coupled to a tray and to a step, and showing portions of right and left leg units of the step stool.
Figure 11:
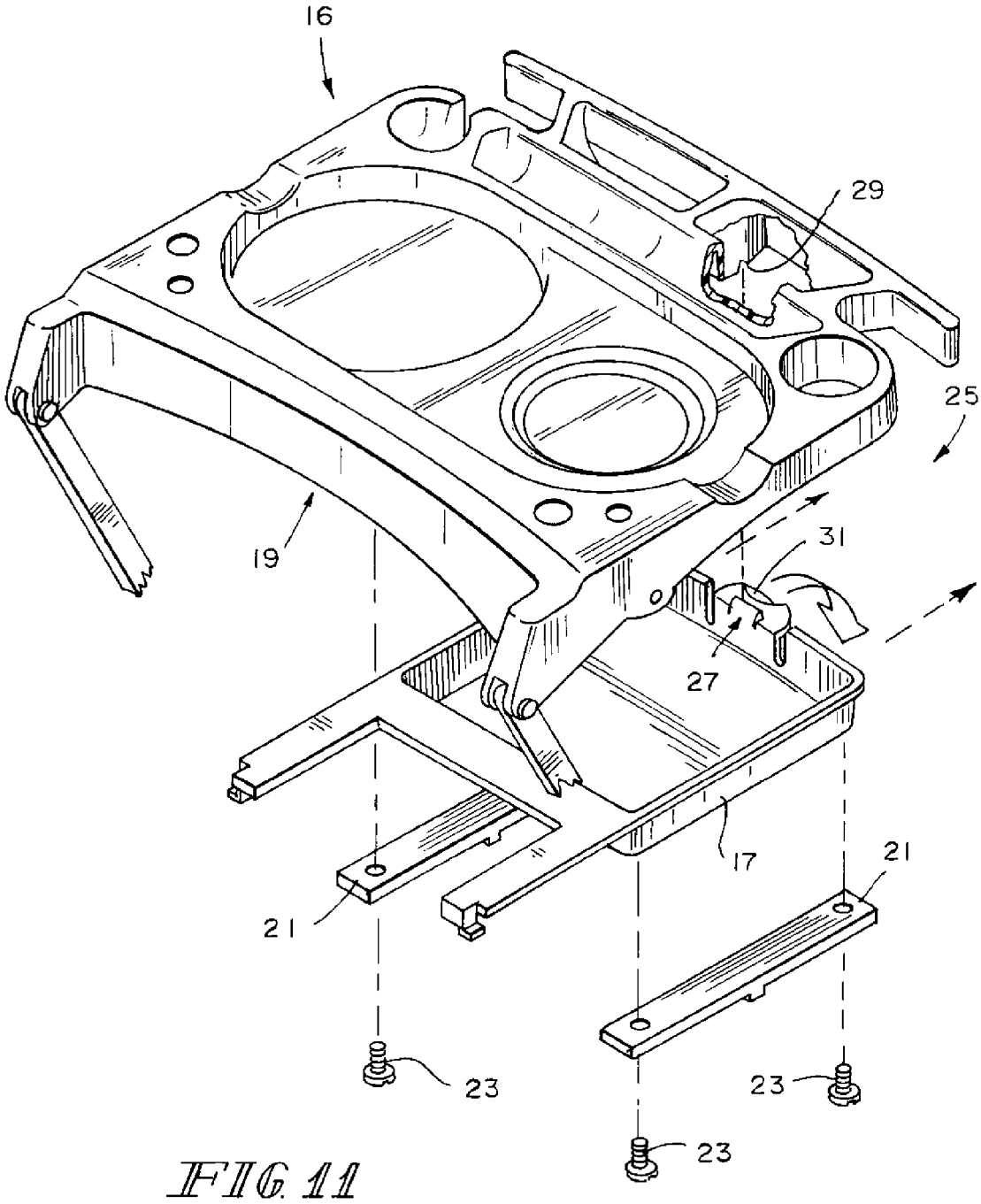
FIG. 11 is a perspective view of a drawer slidably mountable to a tray of the step stools of the present disclosure.

In accordance with the present disclosure, another embodiment, step stool 200, is shown in FIG. 10. The elements of step stool 200 are configured and arranged essentially the same as the embodiment of step stool 10 except for the following. A tray-step controller 213 includes a single connector or bar 215 pivotably coupled to the connected end 106 of tray 16 and pivotably coupled to first step 18, as shown in FIG. 11. Also, when step 18 is lifted, bar 215 causes the rear portion or connected end 106 of tray 16 to move upwardly causing free end 108 of tray 16 to move downwardly and step stool 200 to move to a folded, collapsed position in a single folding motion (not shown, but see FIGS. 7-9 for similar movement of step stool 10).

The invention claimed is:

1. A step stool comprising:

a front leg unit, a rear leg unit pivotably coupled to the front leg unit for movement relative to the front leg unit, a first step pivotably coupled to the front leg unit, a tray mounted for pivotable movement on the front leg unit, and a tray-step controller coupled to the tray and to the first step such that when the step stool is folded toward a collapsed position, the first step and the tray move in unison, the first step in an upward direction and a free end of the tray extending above the rear leg in a downward direction and wherein the tray pivots around a first tray pivot axis in a first rotational direction and the first step pivots around a first front pivot axis in a second, opposite rotational direction in a single folding motion, wherein the tray-step controller includes a slider mounted on the front leg unit and arranged to move slidably on, along, and relative to the front leg unit, a tray-mover pivotably coupled at a first end to the tray and pivotably coupled at a second end to the slider, and a step-mover pivotably coupled at one end to the slider and pivotably coupled at a second end to the first step such that when the first step pivots in the first rotational direction, the step-mover, the slider and the tray-mover cooperate to move the free end of the tray in the downward direction toward the front leg unit between an extended, use position and a retracted, storage position, and wherein the tray-mover is pivotably coupled to the tray and to the step, the tray-mover being configured to push a first portion of the tray upward thereby causing a second portion of the tray to move downward when the first step pivots in the first rotational direction toward a retracted, folded position.

2. A step stool comprising:

a front leg unit, a rear leg unit pivotably coupled to the front leg unit for movement relative to the front leg unit, a first step pivotably coupled to the front leg unit, a tray mounted for pivotable movement on the front leg unit, and a tray-step controller coupled to the tray and to the first step such that when the step stool is folded toward a collapsed position, the first step and the tray move in unison, the first step in an upward direction and a free end of the tray extending above the rear leg in a downward direction and wherein the tray pivots around a first tray pivot axis in a first rotational direction and the first step pivots around a first front pivot axis in a second, opposite rotational direction in a single folding motion, wherein the tray-step controller includes a slider mounted on the front leg unit and arranged to move slidably on, along, and relative to the front leg unit, a tray-mover pivotably coupled at a first end to the tray and pivotably coupled at a second end to the slider, and a step-mover pivotably coupled at one end to the slider and pivotably coupled at a second end to the first step such that when the first step pivots in the first rotational direction, the step-mover, the slider and the tray-mover cooperate to move the free end of the tray in the downward direction toward the front leg unit between an extended, use position and a retracted, storage position, and wherein the tray-mover is pivotably coupled to a connected end of the tray and to the slider such that when the first step is lifted, the slider causes the tray-mover to move the connected end of the tray upwardly and a non-connected end of the tray is caused to pivot about the front leg unit in the second rotational direction and move the free end of the tray downwardly toward the retracted, storage position.

3. The step stool of claim 2, wherein the slider is coupled to the front leg unit such that when the first step is moved in a selected direction, the slider moves in the same direction as the selected direction of the step.

4. A step stool comprising:

a front leg unit, a rear leg unit pivotably coupled to the front leg unit for movement relative to the front leg unit, a first step pivotably coupled to the front leg unit, a tray mounted for pivotable movement on the front leg unit, and a tray-step controller coupled to the tray and to the first step such that when the step stool is folded toward a collapsed position, the first step and the tray move in unison, the first step in an upward direction and a free end of the tray extending above the rear leg in a downward direction and wherein the tray pivots around a first tray pivot axis in a first rotational direction and the first step pivots around a first front pivot axis in a second, opposite rotational direction in a single folding motion, wherein the tray-step controller includes a slider mounted on the front leg unit and arranged to move slidably on, along, and relative to the front leg unit, a tray-mover pivotably coupled at a first end to the tray and pivotably coupled at a second end to the slider, and a step-mover pivotably coupled at one end to the slider and pivotably coupled at a second end to the first step such that when the first step pivots in the first rotational direction, the step-mover, the slider and the tray-mover cooperate to move the free end of the tray in the downward direction toward the front leg unit between an extended, use position and a retracted, storage position, and wherein the slider is located such that the sliding movement of the slider occurs on the front leg unit between where the rear leg unit is pivotably coupled to the front leg unit and where the tray is coupled for pivotable movement on the front leg unit.

5. A step stool comprising:

a front leg unit, a rear leg unit pivotably coupled to the front leg unit for movement relative to the front leg unit, a first step pivotably coupled to the front leg unit, a tray mounted for pivotable movement on the front leg unit, and a tray-step controller coupled to the tray and to the first step such that when the step stool is folded toward a collapsed position, the first step and the tray move in unison, the first step in an upward direction and a free end of the tray extending above the rear leg in a downward direction and wherein the tray pivots around a first tray pivot axis in a first rotational direction and the first step pivots around a first front pivot axis in a second, opposite rotational direction in a single folding motion, wherein the tray-step controller includes a slider mounted on the front leg unit and arranged to move slidably on, along, and relative to the front leg unit, a tray-mover pivotably coupled at a first end to the tray and pivotably coupled at a second end to the slider, and a step-mover pivotably coupled at one end to the slider and pivotably coupled at a second end to the first step such that when the first step pivots in the first rotational direction, the step-mover, the slider and the tray-mover cooperate to move the free end of the tray in the downward direction toward the front leg unit between an extended, use position and a retracted, storage position, and wherein the free end extends in a first direction overlying the rear leg unit when the tray is in the extended, use position, and a connected end of the tray is pivotably coupled at the first tray pivot axis to the front leg unit, the connected end extending in a second direction opposite the first direction and overlying the front leg unit when the tray is in the extended, use position, and the tray is pivotably coupled to the tray-step controller at the connected end of the tray.

6. The step stool of claim 5, wherein the free end of the tray and an end of the first step are arranged to lie in opposing relation to one another in substantially a common plane on a same side of the front leg unit upon upward movement of the first step relative to the front leg unit to the folded, collapsed position of the step stool.

7. A step stool comprising:

a front leg unit, a rear leg unit pivotably coupled to the front leg unit for movement relative to the front leg unit, a first step pivotably coupled to the front leg unit, a tray mounted for pivotable movement on the front leg unit, and a tray-step controller coupled to the tray and to the first step such that when the step stool is folded toward a collapsed position, the first step and the tray move in unison, the first step in an upward direction and a free end of the tray extending above the rear leg in a downward direction and wherein the tray pivots around a first tray pivot axis in a first rotational direction and the first step pivots around a first front pivot axis in a second, opposite rotational direction in a single folding motion, wherein the tray-step controller includes a slider mounted on the front leg unit and arranged to move slidably on, along, and relative to the front leg unit, a tray-mover pivotably coupled at a first end to the tray and pivotably coupled at a second end to the slider, and a step-mover pivotably coupled at one end to the slider and pivotably coupled at a second end to the first step such that when the first step pivots in the first rotational direction, the step-mover, the slider and the tray-mover cooperate to move the free end of the tray in the downward direction toward the front leg unit between an extended, use position and a retracted, storage position, and further comprising a second step and a third step both arranged to lie below the first step at a mid-section of the front leg unit and each of the second and third steps being coupled at second and third front pivot axes, respectively, to the mid-section of the front leg unit, the second and third steps being pivotably coupled at a second and a third rear pivot axes, respectively, to a step connector pivotably coupled to the first step at a first rear pivot axis for pivotable movement of the step connector when the first step is lifted to move the step stool to the collapsed position.

8. The step stool of claim 7, wherein the first rear pivot axis is located on the first step at a lower position than the first front pivot axis on the first step when the first step is in its extended, use position.

9. The step stool of claim 7, further comprising a rear leg connector coupled at a first end to one of the second and third rear pivot axes and at a second end to the rear leg unit at a second leg pivot axis for pivotable movement of the step connector relative to the rear leg unit when the step stool is moved to the collapsed, folded position.

10. A step stool comprising:

a front leg unit, a rear leg unit pivotably coupled to the front leg unit for movement relative to the front leg unit, a first step pivotably coupled to the front leg unit, a tray mounted for pivotable movement on the front leg unit, and a tray-step controller coupled to the tray and to the first step such that when the step stool is folded toward a collapsed position, the first step and the tray move in unison, the first step in an upward direction and a free end of the tray extending above the rear leg in a downward direction and wherein the tray pivots around a first tray pivot axis in a first rotational direction and the first step pivots around a first front pivot axis in a second, opposite rotational direction in a single folding motion, wherein the tray-step controller includes a slider mounted on the front leg unit and arranged to move slidably on, along, and relative to the front leg unit, a tray-mover pivotably coupled at a first end to the tray and pivotably coupled at a second end to the slider, and a step-mover pivotably coupled at one end to the slider and pivotably coupled at a second end to the first step such that when the first step pivots in the first rotational direction, the step-mover, the slider and the tray-mover cooperate to move the free end of the tray in the downward direction toward the front leg unit between an extended, use position and a retracted, storage position, and wherein the tray includes a drawer slidingly coupled to an underside of the tray, the drawer being configured to extend to an opened position in a direction toward and overlying the rear leg unit.

11. The step stool of claim 10, wherein the drawer includes a lock securing the drawer in an unopened position.

12. A step stool comprising:

a front leg unit, a rear leg unit pivotably coupled to the front leg unit for movement relative to the front leg unit, a first step pivotably coupled to the front leg unit, a tray mounted for pivotable movement on the front leg unit, and a tray-step controller coupled to the tray and to the first step such that when the step stool is folded toward a collapsed position, the first step and the tray move in unison, the first step in an upward direction and a free end of the tray extending above the rear leg in a downward direction and wherein the tray pivots around a first tray pivot axis in a first rotational direction and the first step pivots around a first front pivot axis in a second, opposite rotational direction in a single folding motion, wherein the tray-step controller includes a slider mounted on the front leg unit and arranged to move slidably on, along, and relative to the front leg unit, a tray-mover pivotably coupled at a first end to the tray and pivotably coupled at a second end to the slider, and a step-mover pivotably coupled at one end to the slider and pivotably coupled at a second end to the first step such that when the first step pivots in the first rotational direction, the step-mover, the slider and the tray-mover cooperate to move the free end of the tray in the downward direction toward the front leg unit between an extended, use position and a retracted, storage position, and wherein the front leg unit includes a left leg having a lower end, a right leg having a lower end, and a bottom cross-member interconnecting the left and right legs at their respective lower ends, and the first step is directly coupled at the first front pivot axis to mid-sections of the right and left legs and arranged to lie between the right and left legs for pivotable movement about the first front pivot axis, the first step not being directly coupled to the rear leg unit.

13. A step stool comprising a front leg unit, a rear leg unit coupled to the front leg unit for pivotable movement relative to the front leg unit, a tray mounted on the front leg unit for pivotable movement of the tray relative to the front leg unit, the tray including a free end and a connected end, a first step coupled to a mid-section of the front leg unit for pivotable movement of the first step relative to the front leg unit, means for moving the tray in a first rotational direction and the first step in a second, opposite rotational direction when the step stool is moved to a collapsed, folded position, wherein the means includes a tray-step controller pivotably coupled to the connected end of the tray and pivotably coupled to the first step, and wherein the tray-step controller includes a slider mounted on the front leg unit and arranged to slidably move on, along, and relative to the front leg unit, a tray-mover pivotably coupled at one end to the connected end of the tray and pivotably coupled at another end at a slider pivot axis to the slider, and a step-mover pivotably coupled at one end to the slider pivot axis and at another end to the first step.

14. The step stool of claim 13, wherein the tray lies completely below an upper end of the front leg unit when the step stool is in the collapsed, folded position.

15. A step stool comprising a frame including a U-shaped front leg unit comprising a left leg having an upper end and a lower end, a right leg having an upper end and a lower end and lying in spaced-apart relation to the left leg, a lower cross-member interconnecting the lower ends of the left and right legs and configured to contact a surface underlying the frame, and a mid-section located between the lower and upper ends of the legs, a step arranged to lie between the left and right legs and coupled to the mid-sections of the left and right legs of the U-shaped front leg unit at a step pivot point on each of the left and right legs for pivotable movement about a first front pivot axis, the frame further including a rear leg unit coupled to the mid-sections of the left and right legs at leg pivot points located above the step pivot points and below the upper ends for pivotable movement about a first leg pivot axis relative to the front leg unit between an opened position spaced away from the left and right legs and a closed position alongside the left and right legs, a tray having a free end and a connected end, the connected end mounted for pivotable movement at the upper ends of the left and right legs about a first tray pivot axis, a tray-step controller coupled to each of the right and left legs of the front leg unit and pivotably coupled to the tray and to the step and configured to rotate the free end of the tray in a first rotational direction and to rotate the step in a second, opposite rotational direction during movement of the frame to the closed position, and wherein the tray-step controller includes a slider slidably coupled to the front leg unit and configured to move on, along, and relative to a length of the front leg unit, a tray-mover pivotably coupled to the tray and to the slider, and a step-mover pivotably coupled to the slider and to the step.

16. The step stool of claim 15, wherein the step and the free end of the tray are rotated in a single, automatic motion and the entire tray lies below a top of the frame when the frame is moved to the closed position.

* * * * *